US005762323A

United States Patent [19]

Boswell et al.

[11] Patent Number: 5,762,323

[45] Date of Patent: Jun. 9, 1998

[54] FENCE LINE GRASS BARRIER

[76] Inventors: Michael D. Boswell, Rte. 1 Box 363, Louisa, Va. 23093; Matthew A. Clark, Rte. 4 Box 1297, Mineral, Va. 23117

[21] Appl. No.: 498,334

[22] Filed: Jul. 5, 1995

[51] Int. Cl.[6] ..... E04H 17/00; E04B 1/00

[52] U.S. Cl. ..... 256/1; 256/32; 52/100

[58] Field of Search ..... 256/1, 32, 33; 52/100 R, 241, 667; 47/25

[56] References Cited

U.S. PATENT DOCUMENTS

| | | | |
|---|---|---|---|
| 3,384,351 | 5/1968 | Turner | 256/32 |
| 3,515,373 | 6/1970 | Abbe | 256/32 |
| 3,713,624 | 1/1973 | Niemann | 256/32 |
| 3,768,780 | 10/1973 | Cowles et al. | 256/1 |
| 3,963,452 | 6/1976 | Jureit et al. | 52/715 X |
| 3,991,980 | 11/1976 | Blackburn | 256/45 |
| 4,690,382 | 9/1987 | Koperdak | 256/1 |
| 4,821,909 | 4/1989 | Hibler et al. | 52/98 X |
| 5,379,558 | 1/1995 | Mason, III | 52/105 |

FOREIGN PATENT DOCUMENTS

| | | | |
|---|---|---|---|
| 3622427 | 1/1987 | Germany | A01G 1/08 |
| 3717877 | 12/1988 | Germany | A01G 1/08 |
| 526235 | 8/1940 | United Kingdom . | |

*Primary Examiner*—Kenneth J. Dorner
*Assistant Examiner*—William L. Miller
*Attorney, Agent, or Firm*—Sheldon H. Parker

[57] ABSTRACT

The fence-line grass barrier, is a substantially impermeable, flexible member. A series of score-lines are positioned along the flexible member at regular intervals, along the length of the flexible member. The score-lines are stamped into the flexible member to facilitate separation of regions within the score-lines from the barrier member. The score lines or other distance indicators are positioned along the length of the barrier thereby indicating the placement of the fence posts. The score lines have peripheral configurations which correspond to the peripheral configuration of fence posts, such as round, half-round, and square. The barrier has a width substantially greater than the width of the fence, thereby extending beyond the fence and preventing vegetation from growing under and around the fence. The score-lines separate from the flexible member under pressure, thereby forming a hole having a shape which conforms to the shape of the fence post.

17 Claims, 6 Drawing Sheets

FIG.5
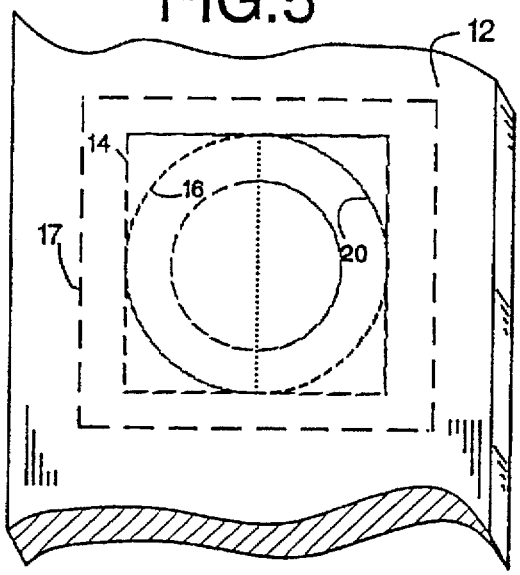
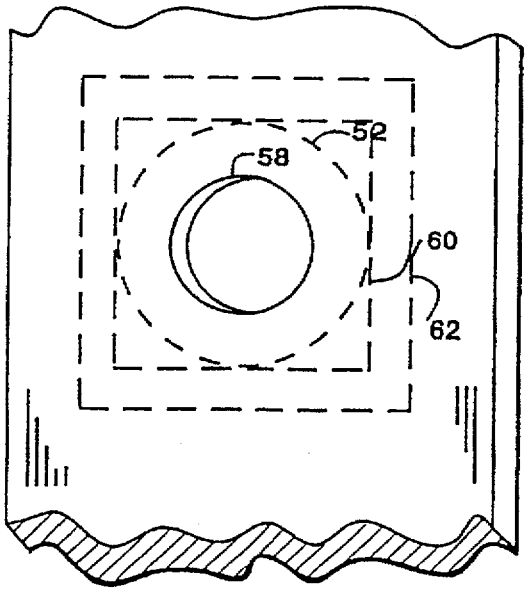
FIG.6

FENCE LINE GRASS BARRIER

BACKGROUND OF THE INVENTION

1. Field of the Invention

The invention relates to a mechanism for inhibiting the growth of grass at a fence line.

2. Brief Description of the Prior Art

The growth of vegetation adjacent to and directly beneath fences has long posed a problem due to the difficulty in keeping this vegetation trimmed. Conventional mowers are not designed to cut grass and woods under and/or immediately adjacent the fence and therefore must be trimmed by hand. Vegetation restricting devices have been disclosed in the prior art, however they are generally expensive to manufacture and/or install.

U.S. Pat. No. 3,515,373 discloses a fence trim guard which incorporates flanged lateral edges on either side of the channel portion. One end is provided with a receiving slot for posts and the other end is flat, interacting with the slotted end to accommodate the posts. The flanged lateral edges of the '373 patent are designed to be set into longitudinal farrows dug into the ground, in line with the fence. The installation of the '373 patent requires either farrow digging equipment or intensive labor, thereby increasing dramatically the cost of installation.

U.S. Pat. No. 3,384,351 to Turner discloses a grass guard which comprises a long roll of arched material to be placed on the ground. Slots are placed along the length of the material to receive the posts. To accommodate various diameters of posts, the slots have a diameter greater than the posts. Cover plates are used to cover any gaps between the diameter of the guard slot and the post. The guard plates serrated peripheral edge around the post receiving slot to allow for post diameter variance. The Turner patent requires a number of pieces to provide a completed fence guard, increasing the complexity of installation as well as the expense of manufacture.

U.S. Pat. Nos. 3,768,780, 3,713,624 and 3,991,980 disclose curved, or right angled, grass guards to prevent grass growth under and approximate fences. These patent require vast amounts of material due to their configurations and are therefore expensive to manufacture. Installation of the '780, 624 and 980 patents is more complex due to their configuration. The '780 patent utilizes an accordion pleat between two concave side panels. The chain link fence is placed within the accordion pleat to keep the guard secure. The '980 patent utilizes a pair of reversed L shaped units which interlock to form a T shape with the fence being attached at the leg of the T. The '624 utilizes a pair of L shaped guards, one leg of the L abutting the fence. Preferably the L shaped guard of the '624 patent also incorporate locking means to lock the pair of guards on either side of the fence.

All of the foregoing patents are disclosed for use with chain link fencing. Some of the foregoing guards can be adapted for use with other types of fencing, such as picket or three board, however the adoptions will involve cutting the material to accommodate the larger post sizes. The instant invention provides an economical, easy to install, fence guard which can readily accommodate standard fence posts without custom cutting of the material.

SUMMARY OF THE INVENTION

The fence-line grass barrier, is a substantially impermeable, flexible member. Preferably it is contained as a roll with fifty feet, one hundred feet or other convenient length of material.

A series of score-lines are positioned along the flexible member at regular intervals, along said length of said flexible member The score-lines are stamped into said flexible member to facilitate separation of regions within said score-lines from said barrier member. The score lines or other distance indicators are positioned along the length of the barrier thereby indicating the placement of the fence posts. The score lines have peripheral configurations which correspond to the peripheral configuration of fence posts, such as round, half-round, and square. The barrier has a width substantially greater than the width of the fence, thereby extending beyond said fence and preventing vegetation from growing under and around said fence. As an additional use, the barrier can be used with highway guard rails, to dramatically reduce the extensive man hours required to maintain the highway areas. The barrier width can be adjusted if a wider area desired.

The score-lines separate from said flexible member under pressure, thereby forming a hole having a shape which conforms to the shape of the fence post. Advantageously, a plurality of score-lines are provided, each of which conforms to the peripheral configuration of different sized or shaped fence posts. Each set of score-lines separate from the flexible member under a different amount of force applied to said score-lines. That is, the score-lines progressively separate from the flexible member based on the size of the periphery of the score lines, with the smallest periphery score-lines separating first. In this manner, when a small post is driven into the ground through the barrier sheet, the minimum sized opening is formed without tearing lose material from within a larger score-line region. Preferably the score lines are spaced approximately eight feet apart.

The barrier material can be used in the following manner in order to align a fence along a boundary, using the fence-line grass barrier. The flexible barrier member is placed at one point along the desired boundary line. The flexible member is extended along the boundary by unrolling a desired length of the flexible barrier material. Each fence post is positioned above its score-line and the fence post is driven into the ground with a post driver which applies pressure to the fence posts causing a score line region, or indicator, to separate from the flexible member. The barrier sheet material is an elongated member from about eight inches wide to about fourteen inches wide. Preferably the barrier is about twelve inches wide and at least about fifty feet long. A connector member is positioned so that it overlies the ends of two adjacent lengths of said fence-line grass barrier to form a contiguous unit having an effective length greater than the length of said two adjacent lengths. Where the barrier sheet material is used with pre-existing posts and a slit is provided from the edge of the barrier sheet to the post hole in the barrier sheet, a connector or clip is clipped over the slit to prevent curling of the slit portion of the barrier sheet.

BRIEF DESCRIPTION OF THE DRAWINGS

The advantages of the instant disclosure will become more apparent when read with the specification and the drawings, wherein:

FIG. 5 is a top view of an barrier of the instant disclosure configured for two different sized round posts and two different sized square holes and half round holes;

FIG. 6 is a top view of an barrier of the instant disclosure scored for two different sized square holes, one round hole and pre-punched for a small round hole;

DETAILED DESCRIPTION OF THE INVENTION

The fence-line grass barrier of the instant disclosure prevents the growth of vegetation under and around fence lines. Two barriers are disclosed herein, thereby accommodating a wide variety of fence posts. Both embodiments are preferably manufactured from recycled materials, such as plastics and rubber tires, as well as scrap plastic. The fence-line grass barrier can be manufactured in various colors and the choice of material of manufacture may be dependent upon the color, such as rubber tires being used for green or black. Other materials, such as high density polyethylene, can be used which meet the criteria set forth. The use of polyethylene, in particular high density polyethylene, is preferred because of the flexibility, durability and stability at a wide range in temperatures. The barriers are preferably, for convenience of storage, sufficiently flexible to allow for the material to be stored in rolls. To provide for long lengths of uncut material being used, the rolls are preferably of a long length and consequently, a lightweight material is beneficial for handling purposes. Plastics such as high density polyethylene additionally provide an advantage by resisting brittleness in low temperatures, while maintaining rigidity in high temperatures. Since in many installations it is likely that the barrier will be stepped on by livestock, the material of manufacture must be resistant to deformity or breakage in extreme temperatures. The thickness and weight of the material must be sufficient to allow the material to lie flat on the ground without twisting or warping. In order to keep the expense of the fence-line grass barrier reasonable, the gauge must be kept to the minimum while preventing twisting or warping. The preferable thickness would be in the range of 020 to 060, with 030 gauge providing optimum cost vs. durability results.

Figure 1:
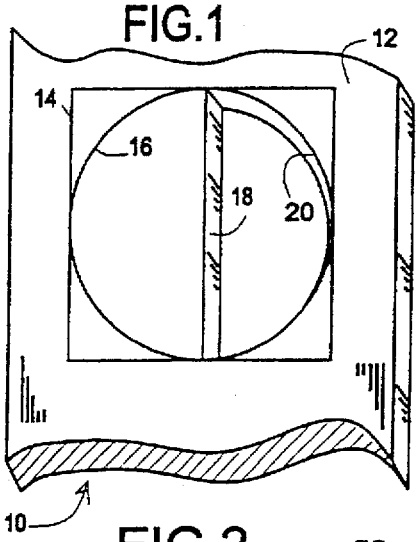
FIG. 1 is a top view of the barrier of the instant disclosure configured for large square, circular or semi-circular posts.

FIG. 1 illustrates the barrier strip 10 which is used for larger posts, such as used in livestock board fencing. The barrier strip 12 is provided with multiple "cut-outs" which are stamped into the barrier strip 12 at predetermined intervals, preferably at the standard fence post eight foot intervals. The predetermined intervals correspond to standard post spacing and can be dependent upon the type of fencing. Although most fences use eight foot spacing, alternate spacing can be provided and is subject to the ability of the machinery to adapt to changes in the frequency or spacing in the hole punching. The stamping for the strip 12 can provide for a square, round, half round, and/or T-shaped post. It has been found that T-posts can be driven through the barrier material without pre-cutting the barrier. However, the pre-cutting provides a convenient mechanism for maintaining a consistent distance between posts.

In order to obtain the correct configuration, the barrier strips 12 are stamped to provide different levels of separation. That is, the inner stampings provide for release under less force than the outer stampings, in order to provide for a preferential separation of pre-punched regions. In this manner, the number of different designs which must be inventoried is reduced.

The pre-punched lines or circles conform to the configuration of standard posts. Most posts are four and six inch rounds, six inch half rounds, and six and eight inch squares. Any desired combination of pre-punched score lines can be used. For example, the barrier sheet material can be provided with a cut out for A) a six inch half circle and scores for a six inch circle, B) scores lines for six and eight inch squares, C) a six inch circle, a six inch square and a six inch half circle, D) score lines for a four inch circle, a six inch half circle and a six inch circle, or E) an eight inch square, a six inch square, a six inch circle, a six inch half circle, and a four inch circle. Advantageous, where combinations of score lines are provided, the score lines provide progressively greater resistance to removal with progressively increasing radial or outermost position. Thus, in example D, the eight inch square should have the greatest resistance to removal, the six inch square next greatest resistance, the six inch circle next and so on, with the four inch circle having the least resistance to removal.

Preferably the width of the barrier strip 12 is sufficient to provide a three inch space between the outermost score line and the edges of the barrier. The space is required primarily to enable a lawn mower to pass over the edge of the barrier. Clearance space between the lawn mover blade and the lawn mower blade housing is typically no less than two inches and therefore a three inch space between the outer edge of the barrier strip and the post will enable the lawn mover to cut to the edge of the barrier strip and negate the need for trimming at the region of the post. The eight inch square thus works best with a fourteen inch wide barrier strip. Six inch half rounds, rounds and square can be accommodated with a twelve inch wide barrier strip. For this reason, it is advantageous to combine six inch or less post holes in a twelve in wide barrier strip and to use eight inch holes with a fourteen inch wide barrier. The space between the perimeter of the outer score lines 14 and the edge 15 of FIG. 1 can be a small as two inches, with the three inch dimension being preferred. Thus, the barrier strip width can be a narrow as ten inches for six inch posts and twelve inches for eight inch posts. It follows then, that a twelve inch wide barrier would provide the desired three inch side clearance with six inch posts and the minimum required clearance of two inches with eight inch posts.

The pre-punched regions can be a plurality of fully or partially punched slit or notches. The length and/or spacing of the slits or notches is adjusted to provide for the inner regions to be punched out independently of the outer regions. Thus in the configuration of FIG. 1, a half-circle formed of a semi-circle 20 and a diameter 18, is provided to accommodate half-circle posts. Pre-punch line 16 has notches or slits which are sufficiently long and close in space to be forced out when a circular post having the diameter of the perforated semi-circle 16, is placed on the barrier strip 12 and driven into the ground. The notches 14, are sufficiently short in length and far enough apart to resist tearing when the full round post is being driven through the barrier region defined by the perforated semi-circle 16. The exact dimensions of the pre-punched notches or slits is not narrowly critical and is dependent upon the strength of the material of the barrier strip 12. The use of partially cut slits or notches provides the advantage of maintaining the barrier adjacent the post, thereby eliminating any opening to allow for unwanted grass growth.

The rectangular outer perforations 14 can be slightly over eight inches square to provide for 8 inch square posts 70. The diameter of the perforated semi-circle 16 can be eight inches. The width of the barrier strip must be greater for eight inch posts than for six inch posts. By this mechanism two units can be inventoried, one of which provides for eight inch half rounds, eight inch rounds, and eight inch square posts and the other of which provides for four and six inch round posts. Thus, two designs can accommodate five different post configurations as well as T-posts.

The perforated semi-circle 16 is partially cut, to a greater degree than the rectangle outer perforations 14, thereby providing a lower resistance to separation than the rectangle outer perforations 14. By cutting the periphery of the perforated semi-circle 16 at a greater degree than the outer perforations 14, the outer perforations 14 separates at a high force or same pressure as compared to the semi-circle 16.

The notches or slits can be as small as a series of small diameter holes and as long as, long lines. The range between 1/16 inch diameter hole and a one-half inch line is preferred. The greater the amount of uncut material in the score line the greater the resistance to removal. Since plastics exhibit a tendency to readily continue tearing once a tear has started, the use of circular cutout provides greater resistance to tearing than elongated pre-punched holes. Accordingly, the outer score line can have circular holes and the inner, lower removal resisting score lines elongated holes. Viewed from the perspective of the uncut portions of the score lines of outer perforations 14 and perforated semi-circle 16, the uncut regions of the outer perforations 14 must be sufficiently greater than that of the score line of the perforated semi-circle 16 to resist tearing when a post is driven within the perforated semi-circle 16. Since posts are driven into the ground under extremely high force, the differential resistance to tearing of the score lines of the outer perforations 14 and perforated semi-circle 16 can be very substantial. The resistance must not be so high as to result in a tearing of the barrier material during the barrier driving step. Thus, the removal resistance can be achieved through a combination of circles and elongated holes, hole size, hole spacing and hole size.

Figure 13:
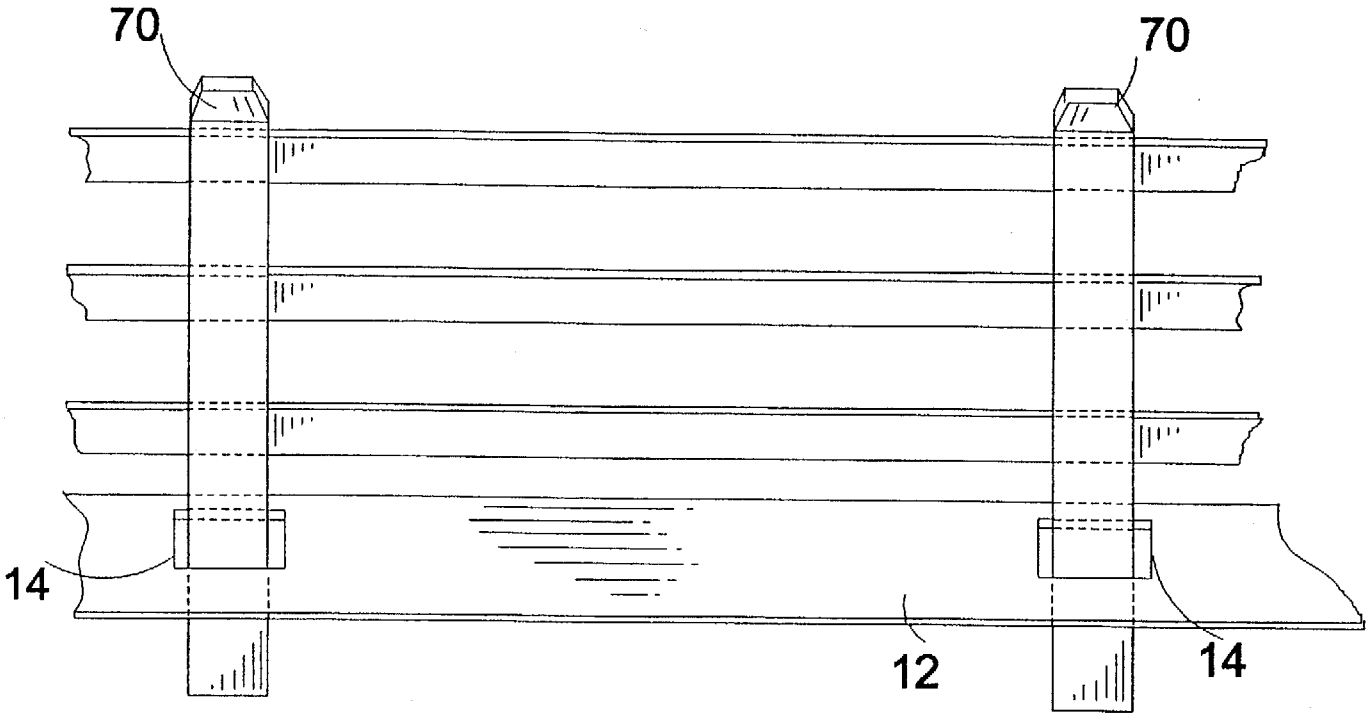
FIG. 13, is a perspective view of the barrier of FIG. 1 installed under a fence.

Through the foregoing pattern of cuts, the strip 12 is prevented from separating in areas other than those which conform to the post 70 shape. Therefore, to install a square post 70, the post would be aligned over the outer perforations 14. When pressure is applied to the post 70, manually or through the use of a powered post driver, the first area to open would be the perforated semi-circle 16. Additional pressure would cause the out perforations 14 to separate from the barrier strip 12. As the post 70 goes further into the ground the pressure causes the perforations around the square 14 to separate. Once the post 70 is in place, the barrier strip 12 fits snugly around the post 70, as illustrated in FIG. 13 preventing growth of vegetation. For use with a half round post, the post would be placed over the portion of the pre-formed semi-circle formed by diameter 18 and semi-circle 20. It is critical that each stage of separation, the perforated semi-circle 16 and outer perforations 14, separate at appropriate pressure.

Figure 2:
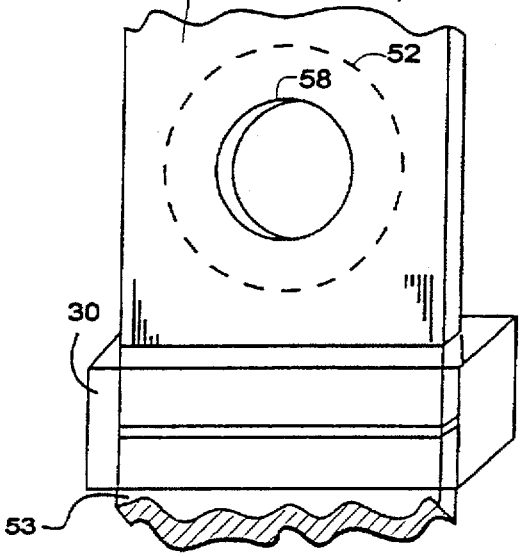
FIG. 2 is a top view of an barrier of the instant disclosure configured for two different sized round posts.

In FIG. 2, the barrier strip 50 has the same basic construction as disclosed for barrier strip 10, providing an alteration in post pattern, except that it can be of a reduced width due to its use with smaller diameter posts than barrier strip 12. T-post slits can be provided but are not essential. If used, the T-post slits can be cut completely through the plastic of the barrier strip 50. The circular score lines forming outer circle 52 and inner circle 58 correspond to the diameter of six and four inch round posts, in the manner as described in conjunction with FIG. 1. The barrier strip 50 can be provided with an inner circle 58 which accommodates smaller posts, such as used for chain link fencing, typically three inches in diameter. Obviously, any combination of diameters can be used and three concentric score lines can be used to accommodate three, four and six inch posts if desired. As noted in regard to FIG. 1, the score-line differences provide for the selective resistance to tearing.

In the preferred embodiment, the width of the barrier strips 10 are approximately twelve inches wide. This width has the advantage that it extends beyond the post a minimum of two inches on each side, allowing for many lawn mowers to cut the vegetation next to the barrier strip, while providing sufficient strength in the region between the outer periphery of the barrier strip 12 and the outer edge of the circle or square. The barrier strip can be in rolls and therefore lengths of over fifty feet can be readily transported. Preferably, the length is at least several hundred feet. The modification of FIG. 2, can be eight inches in width where the posts are three and four inches in diameter. Where the largest post is six inches, the barrier strip width should be ten inches. This provides the strength and rigidity around the posts to prevent the barrier strip from buckling or breaking. This is especially important when a substantial amount of weight is applied approximate the post, such as would occur with horses or cows. While wider barrier strips can be used, in most cases the extra material cost would not be warranted. A narrower strip can be utilized for smaller posts, such as used for chain link, lightweight picket fences and the like. It should be understood that other score line configurations and dimensions can be used, dependent only upon the configuration of the posts which are used with the barrier strip.

Figure 3:
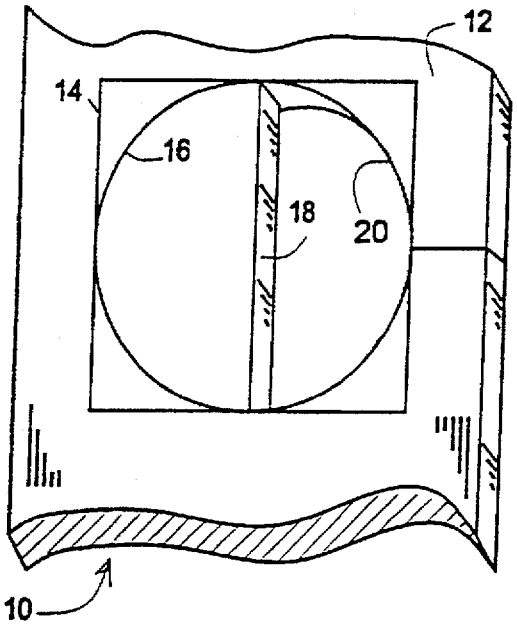
FIG. 3 is a perspective view of a barrier having a pre-cut or user cut slit for slipping the barrier strip around an existing post.
Figure 4:
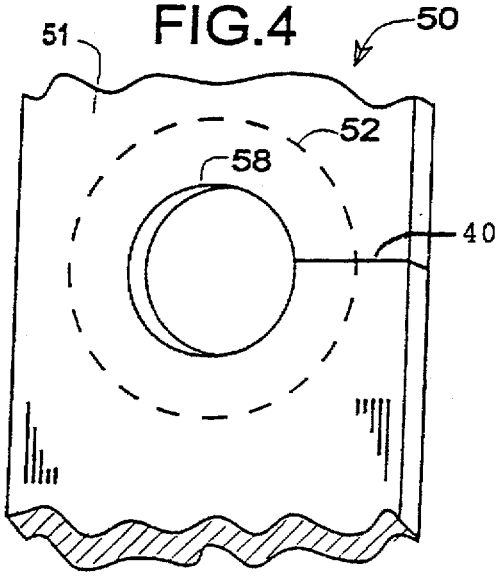
FIG. 4 is a perspective view of a barrier having a pre-cut or user cut slit extending from the pre-cut hole to the edge of the barrier for slipping the barrier strip around an existing post and showing an alternative post hole configuration.
Figure 7:
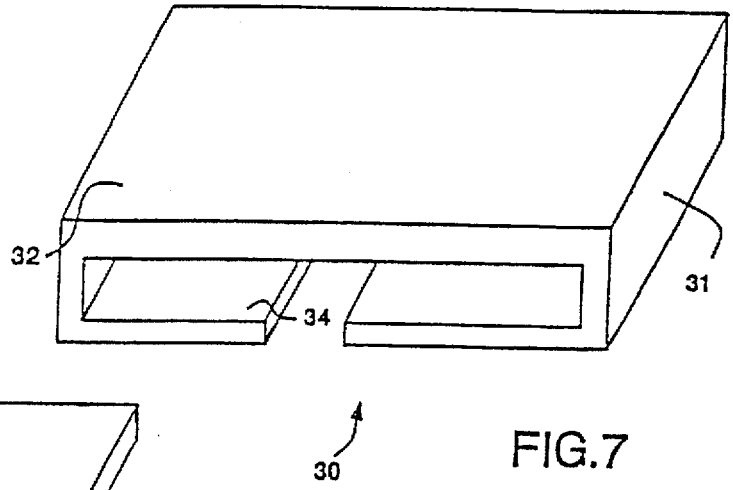
FIG. 7 is a perspective view of a connector for joining two ends of the barrier of the instant invention.

The use of the instant strip barrier strip provides a means for quick installation. By laying the barrier strip 10 or 50 along the intended fence-line, the post locations are pre-marked. This saves the necessity of continually measuring the distance between the posts. Additionally, the chance of placing a fence post off the center line is substantially lessened using the barrier strips.

Where the length of a fence exceeds the length of the barrier material, two lengths of barrier material can be joined with any convenient type of clip mechanism. As shown in FIG. 7, the clip shown generally as 30, can be a member, preferably of plastic which extends around the barrier strip and holds the two end regions together, thereby preventing buckling or curling of the barrier strips. The two barrier strips 51 and 53 are securely held between the top region 32 and the bottom regions 34, and between the ends 31. The clip is dimensioned to be a friction fit. Nails, spikes or the like, are driven through the top region 32 of the clip and through the ends of the barrier strip. The larger the width of the clip 30, the more firmly the ends are held in place. Any desired number of spikes or their equivalent can be used. Preferably, at least two are used so that at least one spike passes through the ends of each of the barrier strips 50 and 53.

Where the barrier sheet material is to be placed around an existing post, the slit 40 of FIGS. 3 and 4, is made between the edge of the sheet material and the post hole. The slit can readily be made at the site by a user, or can be pre-cut. FIGS. 5 and 6 illustrate additional score-line placement through the addition of rectangular score lines 17, 60 and 62.

Figure 8:
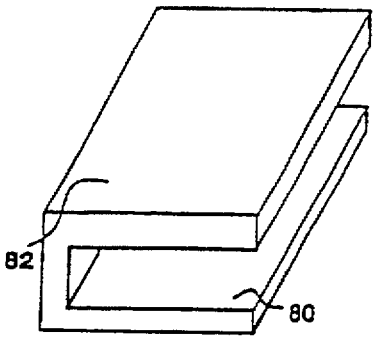
FIG. 8 is a perspective view of a connector for joining two ends of the barrier formed by slitting of the barrier to accommodate a pre-existing post in accordance with the instant invention.
Figure 9:
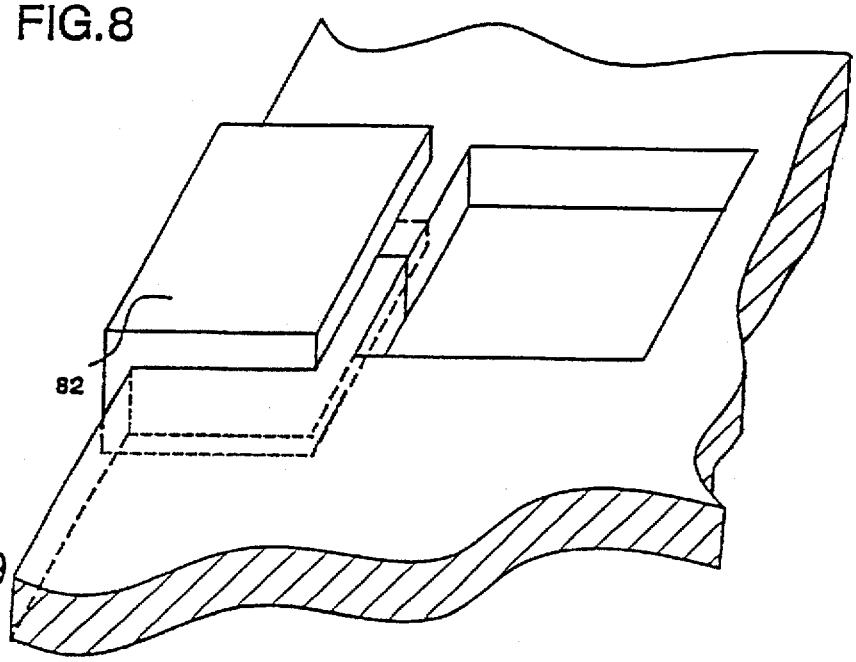
FIG. 9 is a perspective view of the connector of FIG. 8, in position over the slit in the barrier of the instant invention.

A connector, as shown in FIG. 8, is used to prevent curling of the cut portions of the barrier material. The clip can be cut from the connector of FIG. 7. The configuration of the connector of FIG. 7, can readily be formed from a continuous extrusion and cut into desired widths, as for example, two, three or four inches wide. The connector can then be cut to form the edge clip of FIG. 8 thereby forming a clip having a top region 82 and a bottom region 80. The clip is shown in position in FIG. 9.

Figure 12:
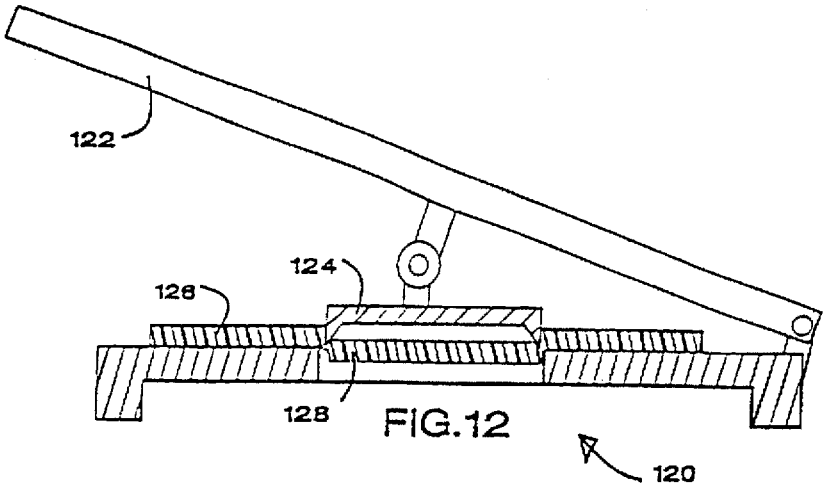
FIG. 12, is a side view of the punch device of FIG. 10, with a barrier strip and a partly punched hole.
Figure 10:
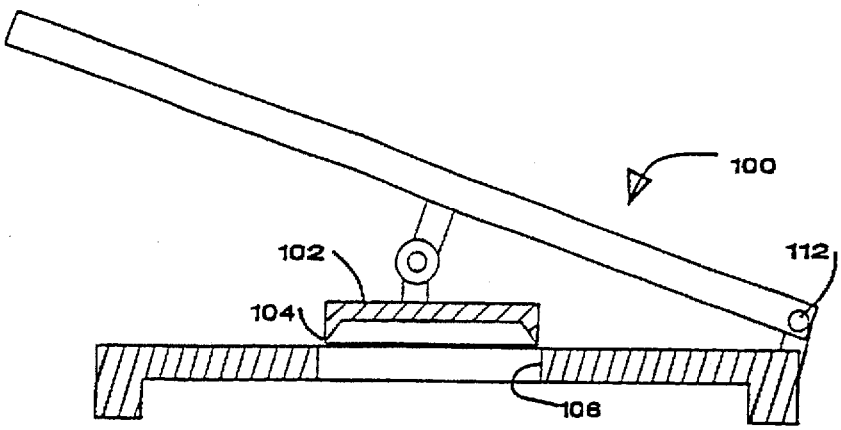
FIG. 10, is a side view of a punch device for punching square, circular or half circle holes in a barrier strip.
Figure 11:
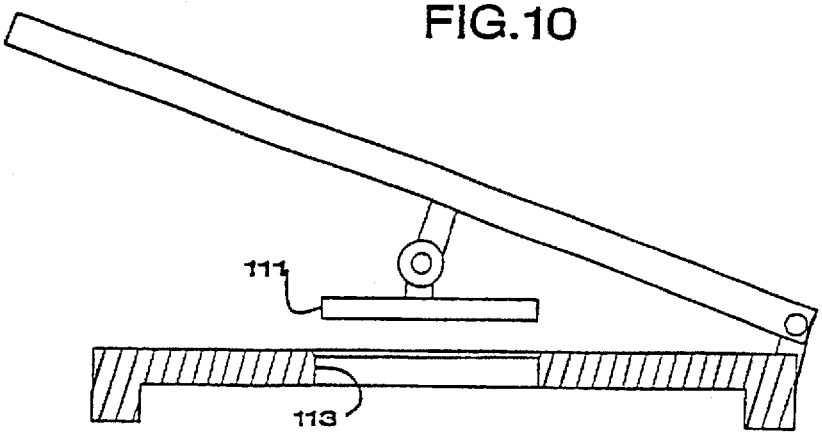
FIG. 11, is a side view of an alternative embodiment of a punch device for punching square, circular or half circle holes in a barrier strip.

Particularly where the barrier strip is to be used with pre-existing posts, the holes can be cut or punched at the site, so that the hole spacing coincides with the actual spacing between posts. A die cutter or punch of essentially conventional form can be used to punch round, half round or square holes. A shown in FIG. 10, the punch 100 has a handle 122, which is hinged at 112 to the base of the punch 100. A hole 106 is provided which conforms to the shape of the hole to be punched. The die 102 can have beveled cutting edges 104 or, alternatively, the punch can be a square edge member 111 which forces material through the hole 113, as illustrated in FIG. 11. As shown in FIG. 12, the punch 120 is is used to form a hole in a plastic barrier sheet 126. The die 124 forces a portion 128 of the thin plastic barrier sheet 126, into the receiving hole, thereby forming a post receiving hole. The barrier strip can then be slit with a knife or scissors to wrap around the post.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A fence-line grass barrier for use with a fence, said fence having horizontal structure supported by a plurality of fence posts, said barrier being a substantially impermeable, flexible member having:

a length, a first end, a second end, and a series of indicator units positioned at a predetermined distance from one another and approximately centered along said length of said flexible member, each of said indicator units being defined by multiple score-lines to facilitate the separation of said indicator units from said flexible member, each of said multiple score-lines having a shape and periphery which correspond to the shape and periphery of the fence post, the positioning of said indicator units along said length indicating the placement of a line of the fence posts, wherein said flexible member has a width substantially greater than a width of said horizontal structure, thereby extending beyond the fence and preventing vegetation from growing under and around the fence.

2. The fence-line grass barrier of claim 1 wherein said score-lines of each of said indicator units define a plurality of fence post shapes and peripheries, having a slightly greater periphery than the shape and periphery of each of said plurality of fence posts.

3. The fence-line grass barrier of claim 2 wherein said score-lines facilitate separation of at least of said multiple score-lines from said flexible member upon application of pressure.

4. The fence-line grass barrier of claim 3 wherein each of said score-lines separates from said flexible member, conforming to the shape and periphery of said fence post, as increased pressure is applied to said score-lines by said fence post.

5. The fence-line grass barrier of claim 3 wherein the force required to separate said score-lines from said flexible member is controlled by the depth and frequency of said score-lines.

6. The fence line grass barrier of claim 5 wherein the order of separation of said score-lines is based on the size of the periphery of the score-line, the smallest periphery separating first, thereby as pressure is applied by said fence post, said indicator units separate from said flexible member until the periphery of said score-line is equal to the periphery of said fence post.

7. The fence-line grass barrier of claim 1 wherein a center of said indicator units is placed approximately eight feet apart along said length of said flexible member.

8. The fence-line grass barrier of claim 1, further comprising a connector member, said connector member overlying the ends of two adjacent lengths of said fence-line grass barrier to form a contiguous unit having an effective length greater than the length of said two adjacent lengths, said connector interior being dimensioned to form a friction fit with said fence-line barrier.

9. The fence-line grass barrier of claim 1 further comprising a connector line, said connector line extending normal to said indicator units and connecting said indicator unit to an edge of said barrier.

10. The fence-line grass barrier of claim 1, wherein said barrier is an elongated member from about ten inches wide to about fourteen inches wide.

11. The fence-line grass barrier of claim 10, wherein said barrier is about twelve inches wide.

12. The fence-line grass barrier of claim 1, wherein said barrier is at least fifty feet long.

13. The method of aligning a fence along a boundary using a fence-line grass barrier, said barrier being a substantially impermeable flexible member having a length, a first end, a second end, and a series of score-lines, said score-lines being partially cut into said flexible member along said length to indicate the location in which to place fence posts, comprising the steps of:

determining a fence-line boundary;

placing said flexible member at one point along said boundary;

extending said flexible member along said boundary;

positioning fence posts above said score-lines;

applying pressure to said fence posts, said pressure causing said score-lines to separate from said flexible member.

14. The method of aligning a fence of claim 13 wherein each of said score-lines has been partially cut in the shape of an end of the fence post.

15. The method of aligning a fence of claim 14 wherein each of said score-lines is a multiple indicator partially cut in the shape of the ends of multiple said fence posts.

16. The method of aligning a fence of claim 15 wherein the increase of pressure applied to each of said multiple score-lines separates each said shape of the end of the fence post from said flexible member under a different amount of force applied to said indicator.

17. The method of aligning a fence of claim 15 wherein said each shape within said multiple score-lines progressively resists separating from said flexible member based on the size of the periphery of the indicator, the smallest periphery separating first.

* * * * *